US008944410B1

(12) United States Patent
Skubisz

(10) Patent No.: US 8,944,410 B1
(45) Date of Patent: Feb. 3, 2015

(54) FENCE POST EXTRACTION TOOL

(71) Applicant: Robert Skubisz, Burbank, IL (US)

(72) Inventor: Robert Skubisz, Burbank, IL (US)

( * ) Notice: Subject to any disclaimer, the term of this patent is extended or adjusted under 35 U.S.C. 154(b) by 218 days.

(21) Appl. No.: 13/717,948

(22) Filed: Dec. 18, 2012

(51) Int. Cl.

| | |
|---|---|
| ***E21B 19/00*** | (2006.01) |
| ***B21F 9/00*** | (2006.01) |
| ***B23P 19/04*** | (2006.01) |
| ***E04H 17/26*** | (2006.01) |

(52) U.S. Cl.
CPC ..... *E04H 17/265* (2013.01)
USPC ..... 254/30; 254/231; 29/255; 29/256

(58) Field of Classification Search
CPC ... E04H 17/265; E04H 17/263; E04H 17/261; E04H 17/26
USPC ..... 254/30, 4 R, 100, 103, 134, 133 R, 120; 29/255, 256, 267
See application file for complete search history.

(56) References Cited

U.S. PATENT DOCUMENTS

| | | | | | |
|---|---|---|---|---|---|
| 1,778,682 | A | * | 10/1930 | McManus | 254/132 |
| 2,087,148 | A | * | 7/1937 | Hempy | 254/25 |
| D199,019 | S | * | 8/1964 | Marson | D8/89 |
| 3,961,410 | A | * | 6/1976 | Reed | 29/256 |
| 4,161,310 | A | * | 7/1979 | Parker | 254/30 |
| 4,792,120 | A | * | 12/1988 | Egaas | 254/30 |
| 5,365,648 | A | * | 11/1994 | Fuga | 29/254 |
| D361,248 | S | * | 8/1995 | Harper et al. | D8/51 |
| 6,505,817 | B1 | * | 1/2003 | Witter | 254/25 |
| 7,040,602 | B1 | * | 5/2006 | Williams | 254/30 |
| 8,522,412 | B1 | * | 9/2013 | Walker | 29/255 |
| 2004/0113132 | A1 | * | 6/2004 | Irving | 254/30 |
| 2006/0108568 | A1 | * | 5/2006 | Payne | 254/30 |
| 2013/0048928 | A1 | * | 2/2013 | Bitner | 254/231 |

* cited by examiner

*Primary Examiner* — Lee D Wilson
*Assistant Examiner* — Nirvana Deonauth
(74) *Attorney, Agent, or Firm* — Kyle A. Fletcher, Esq.

(57) ABSTRACT

The fence post extraction tool is a tool used to extract a wooden fence post from the ground using only vertical movement. The wooden fence post extraction tool includes a threaded rod that screws into an expanding piercing tip. The expanding piercing tip is driven into a pre-drilled hole located on a top surface of the wooden fence post. The piercing tip is driven into the hole via a hammer sleeve that is slideable engaged about the threaded rod. The threaded rod is attached to an attachment clip located at a distal end from the piercing tip. The attachment clip secures to a lifting means suspended under a tripod, and which lifts the wooden fence post vertically from the ground.

15 Claims, 6 Drawing Sheets

FENCE POST EXTRACTION TOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of extraction apparatuses, more specifically, an extraction apparatus for use in removing a fence post.

Fence posts can be difficult to extract when requiring replacement or removal. Extraction of a wooden post often amounts to digging a hole around the base of the post in order to thereafter free said wooden post from the ground. There have been a lot of devices directed to extraction of posts from a seated position in the ground, and they enjoy advantages and disadvantages. One disadvantage is that the post may be subjected to a rotational motion or partially vertical and partially rotational motion when extracting from the ground. The problem with the use of any rotational motion on a wooden post in the ground is that the portion of the wooden post submerged underground may be partially or totally rotten, and thus break off and remain submerged underground.

What is needed is a tool that extracts a wooden post from the ground employing only vertical movement in order to extract said post, and thereby eliminating the difficulty in extracting a portion of said post that remains underground when subjected to partial or full rotational extracting motion. The device of the present application seeks to address this need.

B. Discussion of the Prior Art

As will be discussed immediately below, no prior art discloses a wooden fence post extraction tool that consists of a threaded rod that screws into an expanding piercing tip that is driven into a pre-drilled hole located on a top surface of a fence post; wherein the threaded rod includes a hammer sleeve that is slideably engaged thereon, and which is used to drive the piercing tip into the hole on the top surface of the fence post; wherein an attachment clip is secured between a distal end of the threaded rod and a lifting means mounted under a tripod in order to drive upwardly the fence post along a vertical axis.

The Harper et al. (U.S. Pat. No. Des. 361,248) illustrates a design for a post puller, which does not illustrate a threaded rod or piercing tip for use in driving into a post to be extracted.

The Witter (U.S. Pat. No. 6,505,817) discloses a framework removal tool utilizing a lever arm. However, the framework removal tool does not extract a fence post from the ground via use of a piercing tip, threaded rod, lifting means, and tripod.

The Egaas (U.S. Pat. No. 4,792,120) discloses a device for extracting and pulling posts. However, the device relies on a back wall and teeth to engage a post immediately above the ground surface, and from there requires rotational movement in order to extract the post form the ground as opposed to vertical extraction of said post.

The Parker (U.S. Pat. No. 4,161,310) discloses an elongated bar that is pivotally attached to a vertical support bar and that the elongated portion attaches to a fence post, and using force from the fulcrum of the support bar the post is lifted straight out of the ground. However, the elongated bar relies upon rotational movement in order to extract a fence post, and not vertical movement from above the fence post for extraction.

The Payne Patent Application Publication (U.S. Pub. No. 2006/0108568) discloses a portable post puller. However, the portable post puller relies on rotational movement in order to extract the post, and not purely vertical movement.

The McNamus (U.S. Pat. No. 1,778,682) discloses a post puller. Again, the post puller relies on rotational movement in order to extract the post, and not a purely vertical movement to extract said post.

The Irving Patent Application Publication (U.S. Pub. No. 2004/0113132) discloses a tool for extracting remnants of sign posts. However, the tool engages a metal post having holes, and is spring loaded, and not employing the use of a piercing tip and threaded rod to engage a top surface of a wood fence post in order to thereafter extract via a hoisting means or lifting means.

While the above-described devices fulfill their respective and particular objects and requirements, they do not describe a wooden fence post extraction tool that consists of a threaded rod that screws into an expanding piercing tip that is driven into a pre-drilled hole located on a top surface of a fence post; wherein the threaded rod includes a hammer sleeve that is slideably engaged thereon, and which is used to drive the piercing tip into the hole on the top surface of the fence post; wherein an attachment clip is secured between a distal end of the threaded rod and a lifting means mounted under a tripod in order to drive upwardly the fence post along a vertical axis. In this regard, the fence post extraction tool departs from the conventional concepts and designs of the prior art.

SUMMARY OF THE INVENTION

The fence post extraction tool is a tool used to extract a wooden fence post from the ground using only vertical movement. The wooden fence post extraction tool includes a threaded rod that screws into an expanding piercing tip. The expanding piercing tip is driven into a pre-drilled hole located on a top surface of the wooden fence post. The piercing tip is driven into the hole via a hammer sleeve that is slideable engaged about the threaded rod. The threaded rod is attached to an attachment clip located at a distal end from the piercing tip. The attachment clip secures to a lifting means suspended under a tripod, and which lifts the wooden fence post vertically from the ground.

An object of the invention is to provide a fence post removal tool that works to extract a wooden fence post along a vertical axis.

A further object of the invention is to provide a piercing tip and threaded rod having a hammer slideable engaged thereon, and which enables the piercing tip to be driven into and expanding inside of a pre-drilled hole located on a top surface of the wooden fence post to be extracted.

A further object of the invention is to provide a hammer that slides up and down along the threaded rod, which aids in driving the piercing tip into the drilled hole.

A further object of the invention is to provide a piercing tip that has expanding armatures that engage the interior of the hole drilled into the wooden fence post.

Another object of the invention is to include a lifting means and tripod that are placed above the threaded rod and attach via the attachment clip.

These together with additional objects, features and advantages of the fence post extraction tool will be readily apparent to those of ordinary skill in the art upon reading the following detailed description of presently preferred, but nonetheless illustrative, embodiments of the fence post extraction tool when taken in conjunction with the accompanying drawings.

In this respect, before explaining the current embodiments of the fence post extraction tool in detail, it is to be understood that the fence post extraction tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the fence post extraction tool.

It is therefore important that the claims be regarded as including such equivalent construction insofar as they do not depart from the spirit and scope of the fence post extraction tool. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
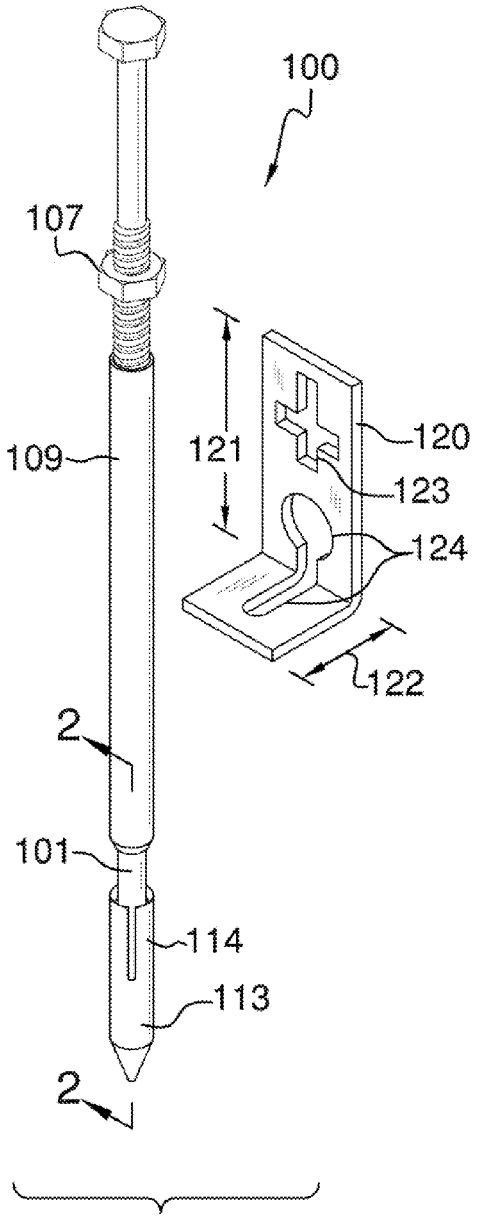
FIG. 1 illustrates a perspective view of the attachment clip as well as the threaded rod and piercing tip.
Figure 2:
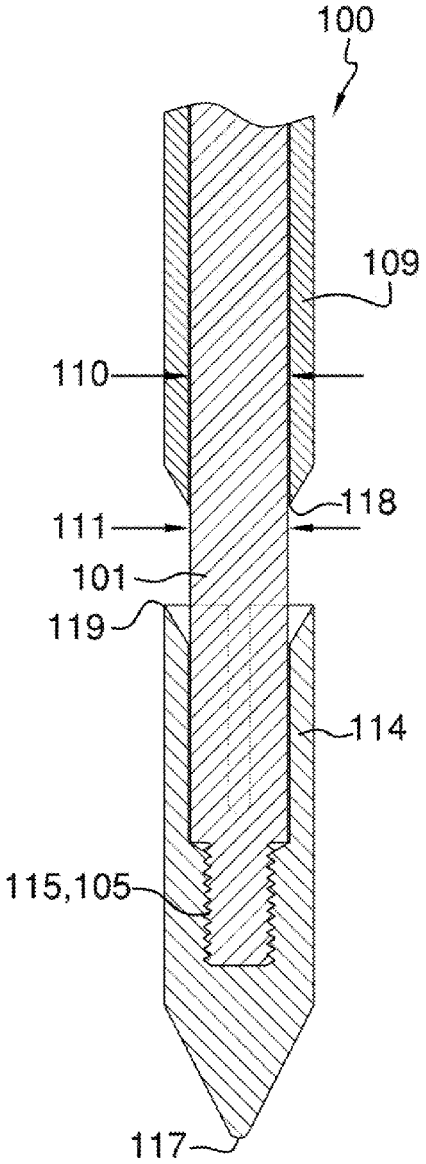
FIG. 2 illustrates a cross-sectional view along line 2-2 in FIG. 1, and detailing the piercing tip and threaded rod.
Figure 3:
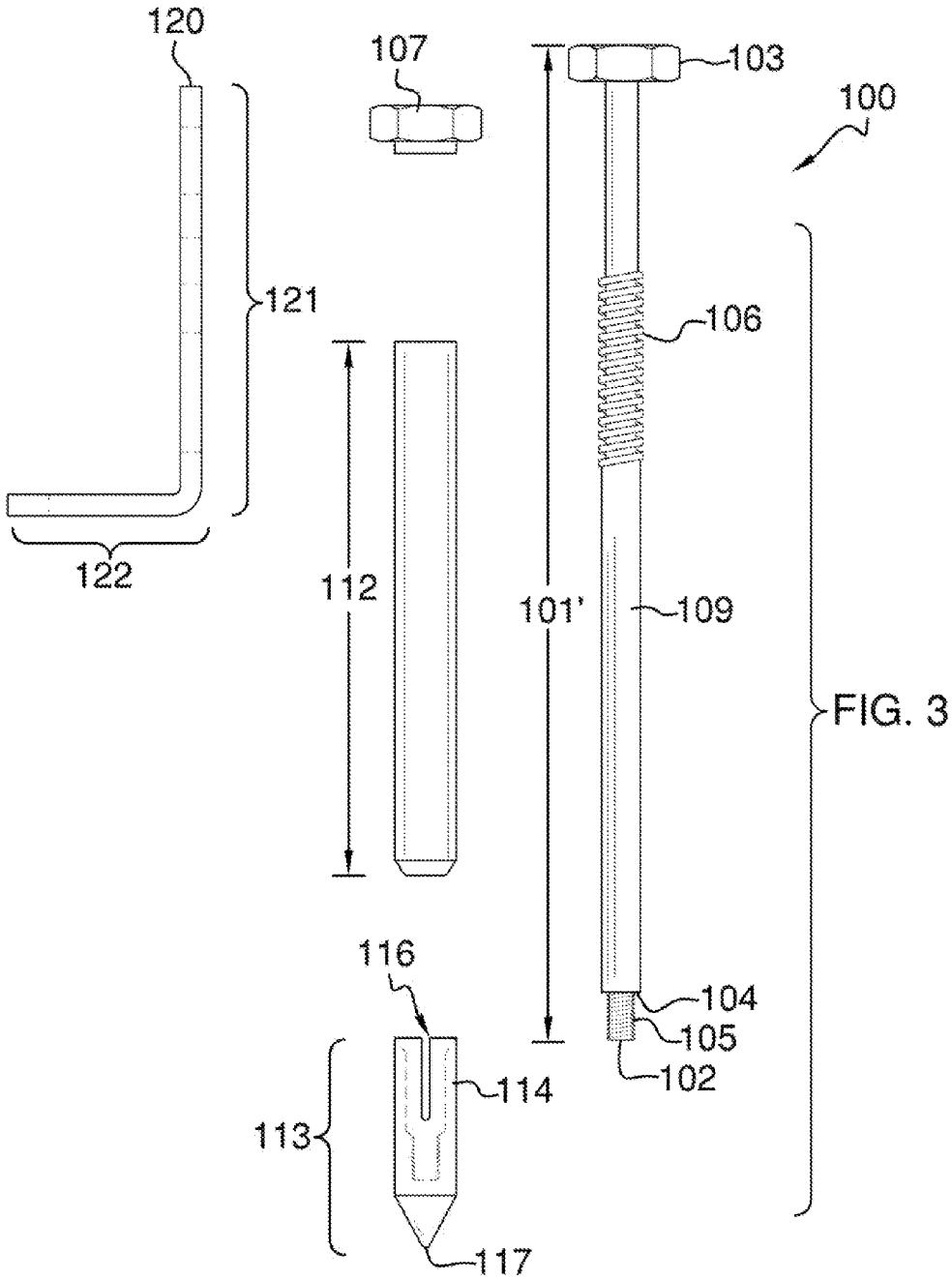
FIG. 3 illustrates another exploded view of the threaded rod and piercing tip as well as the profile of the attachment clip.
Figure 4:
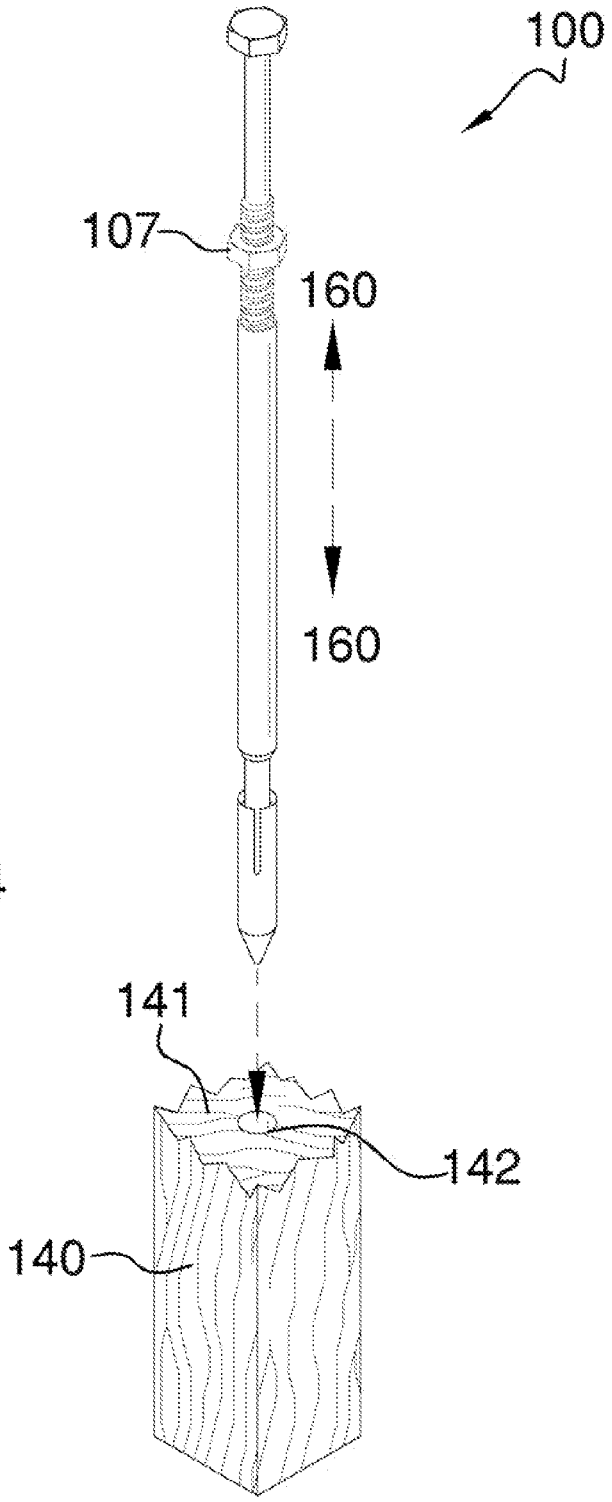
FIG. 4 illustrates a view of the piercing tip aligned above a pre-drilled hole located on a top surface of the wooden fence post as well as the sliding motion of the hammer with respect to the threaded rod.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-7. A fence post extraction tool 100 (hereinafter invention) includes a threaded rod 101 of an undefined length 101', and having a bottom distal end 102 and a top distal end 103. The top distal end 103 may be a hexagonally-shaped protuberance so as to work with a ratchet or wrench as needed. The bottom distal end 102 includes a shoulder 104 from which are bottom external threading 105. The top distal end 103 includes top external threading 106 for use with a threaded nut 107. A hammer sleeve 109 is included with the threaded rod 101, and is slideably engaged therewith. The hammer sleeve 109 has the shape of a hollowed cylinder having an inner diameter 110 greater than an outer diameter 111 of the threaded rod 101.

The hammer sleeve 109 has a hammer length 112 that is less than the length 101' of the threaded rod 101. The hammer sleeve 109 is used to generate a downward force onto a piercing tip 113 when so attached to the threaded rod 101. The piercing tip 113 includes armatures 114 that branch upwardly and outwardly from a threaded hole 115 into which the bottom external threading 105 at the bottom distal end 103 of the threaded rod 101 secures. The armatures 114 of the piercing tip 113 are equally spaced and arranged and form grooves 116 that expand and contract as the armatures 114 move. The piercing tip 113 also includes a point 117 that is to be first inserted into a pre-drilled hole 142 located on a top surface 141 of a wooden fence post 140 that is to be extracted from the surrounding ground 150.

It shall be noted that the pre-drilled hole 142 shall have an inner diameter 170 that is less than an outer armature width 171 so as to produce a squeezing effect on the armatures 114 when driven into the pre-drilled hole 142. More the point, the pre-drilled hole 142 shall be drilled at a depth 172 that is greater than a piercing tip length 173. It shall, be noted that the wooden fence post 140 is partially submerged into the surrounding ground 150, and upon use of the invention 100 is extracted upwardly along a vertical axis 160.

The hammer sleeve 109 is pulled upwardly and rammed downwardly in order to impact a bottom hammer surface 118 onto a top armature surface 119 of the piercing tip 113. The hammer sleeve 109 generates a driving force that pushes the piercing tip 113 inside of the pre-drilled hole 142 until the armatures 114 are fully engaged inside of the pre-drilled hole 142 at which time the piercing tip 113 is fully secured to the wooden fence post 140.

The invention 100 includes an attachment clip 120 that has an "L" shape (see FIG. 3) further defined by a vertical portion 121 and a horizontal portion 122. The vertical portion 121 includes a "+" shaped opening 123 whereas the horizontal portion 122 and vertical portion 121 share a grooved slot 124. The grooved slot 124 enables the top distal end 103 to pass through and engage against the threaded nut 107. The "+" shaped opening 123 enables a lifting means 125 to attach thereon such that the attachment clip 120 is rigidly secured between the threaded rod 101 and the lifting means 125.

Figure 5:
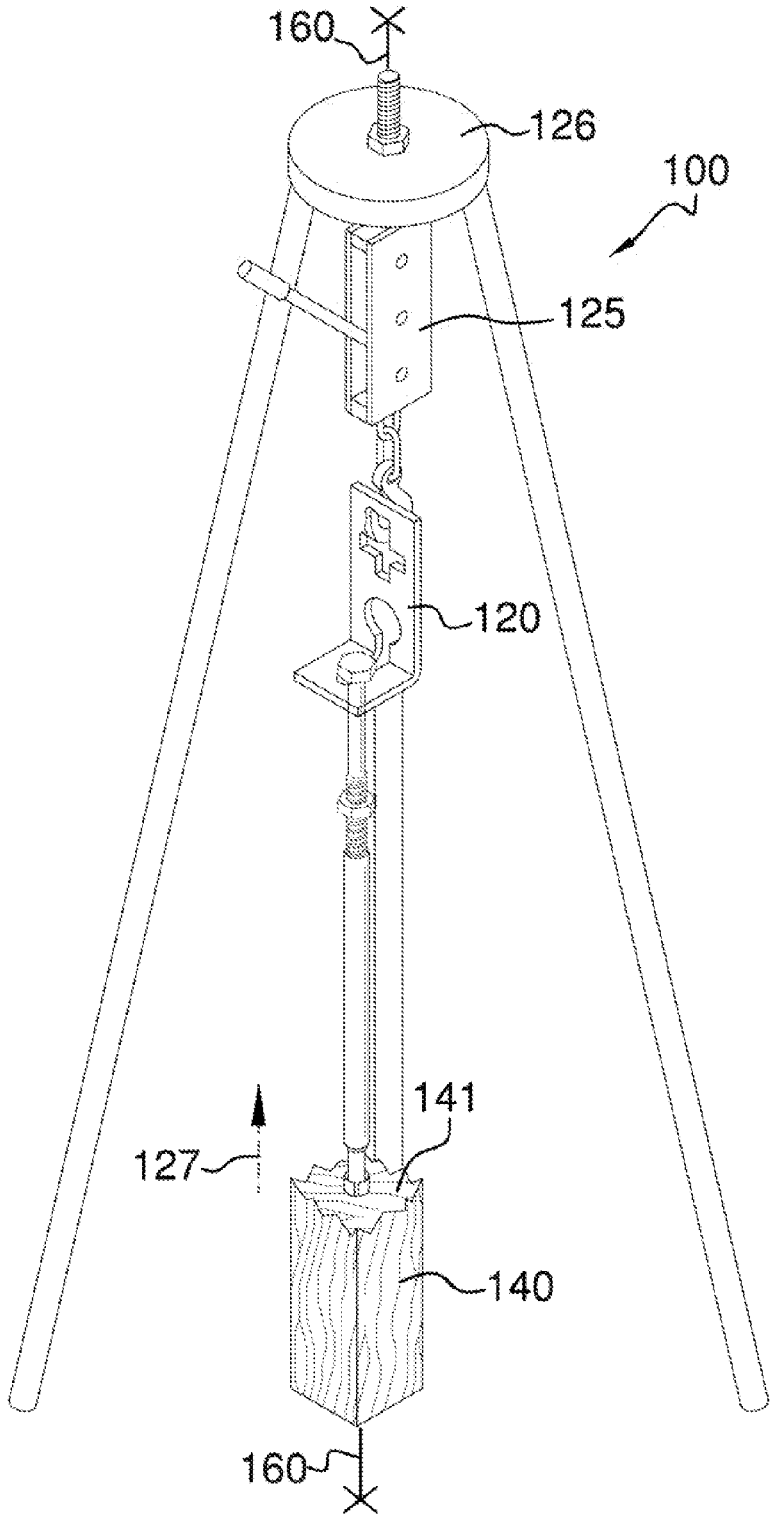
FIG. 5 illustrates a view of the threaded rod and piercing tip securely anchored to the wooden fence post while the lifting means is extracting the post from the ground.
Figure 6:
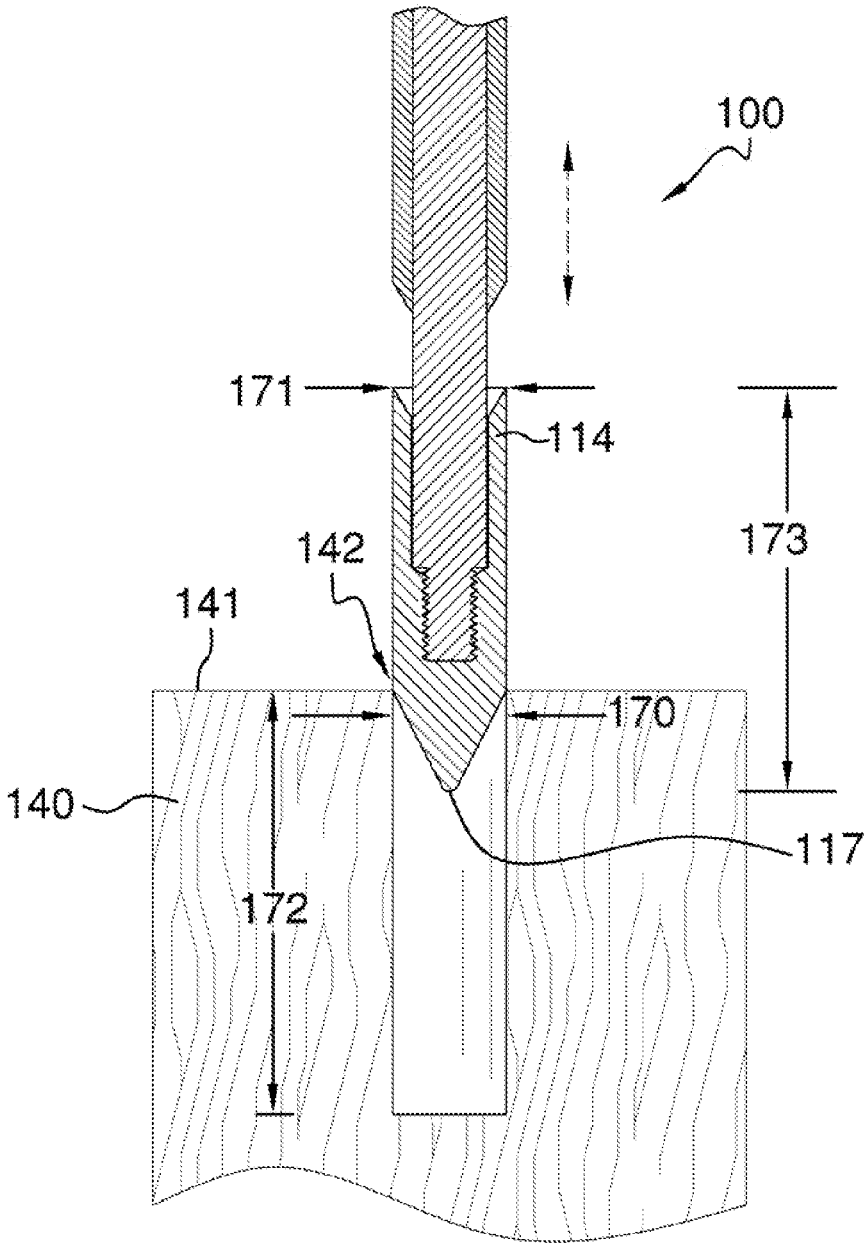
FIG. 6 illustrates a cross-sectional view of the piercing tip entering into the pre-drilled hole in the fence post.
Figure 7:
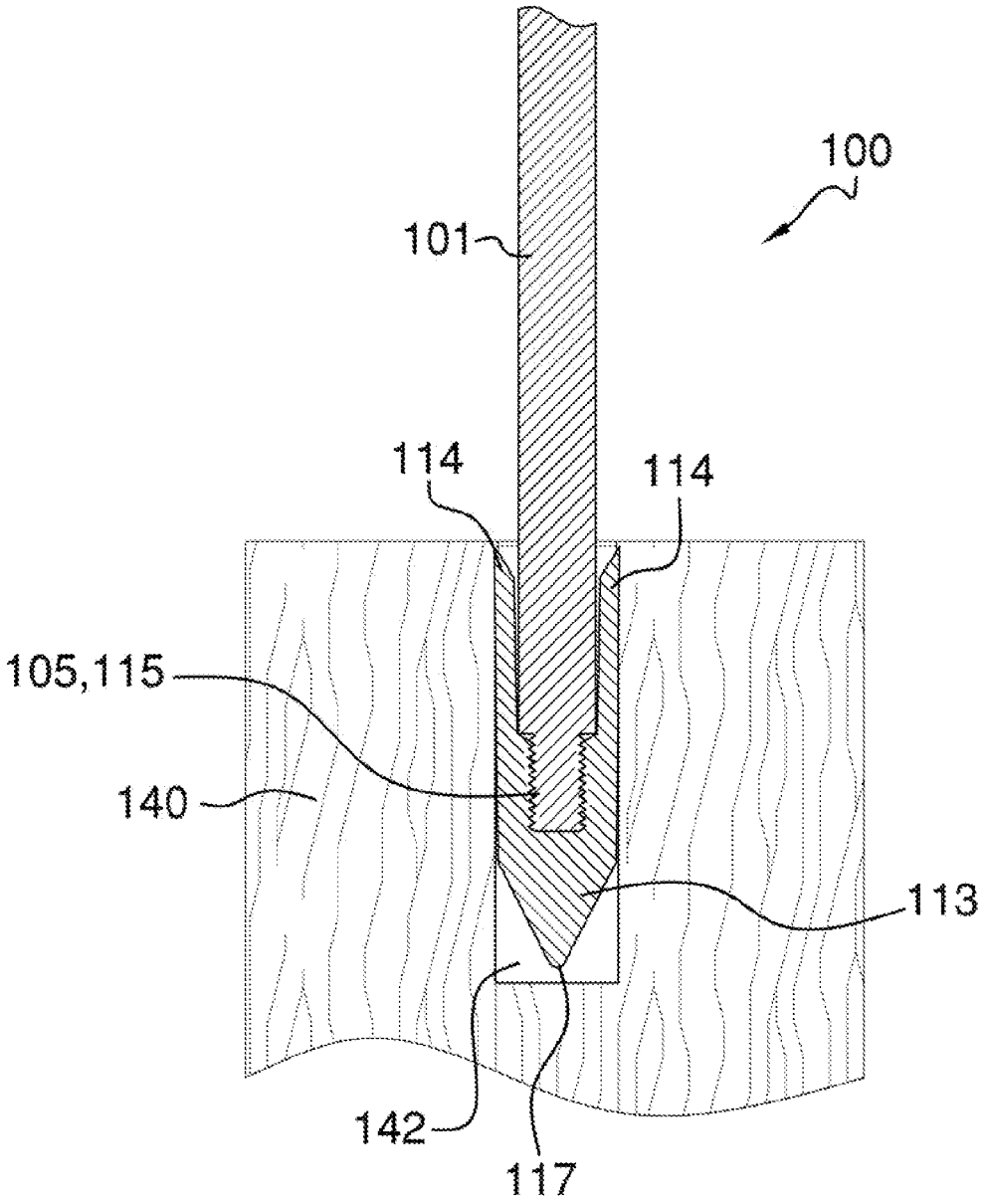
FIG. 7 illustrates a cross-sectional view of the piercing tip securely seated inside of the pre-drilled hole of the fence post, and ready for extraction.

Referring to FIG. 5, the lifting means 125 is suspended under a tripod 126, and is used to create a lifting force 127 in extraction of the wooden fence post 140 along the vertical axis 160. The type and shape of the lifting means 125 and/or tripod 126 is not to be limiting. It shall be noted that the lifting means may be manually or machine-powered, and the tripod 126 may include more than 3 legs or otherwise.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. The fence post extraction tool comprising: a threaded rod threadably engaged to a piercing tip that is hammered into a pre-drilled hole located on a top surface of a wooden fence post to be extracted upwardly along a vertical axis; wherein an attachment clip is secured between the threaded rod and a lifting means that is suspended under a tripod; wherein the threaded rod is of a length and has a bottom distal end as well as top distal end; wherein the bottom distal end includes a shoulder from which are bottom external threading; wherein the top distal end includes top external threadings for use with a threaded nut; wherein a hammer sleeve is included with the threaded rod and is slideably engaged therewith; wherein the hammer sleeve has the shape of a hollowed cylinder having an inner diameter greater than an outer diameter of the threaded rod; wherein the attachment clip has an "L" shape further defined by a vertical portion and a horizontal portion; wherein the vertical portion includes a "+" shaded opening whereas the horizontal portion and vertical portion share a grooved slot; wherein the grooved slot enables the top distal end to pass through and engage against the threaded nut.

2. The fence post extraction tool as described in claim 1 wherein the hammer sleeve has a hammer length that is less than the length of the threaded rod; wherein the hammer sleeve is used to generate a downward force that hammers the piercing tip into said pre-drilled hole.

3. The fence post extraction tool as described in claim 2 wherein the piercing tip includes armatures that branch upwardly and outwardly from a threaded hole into which the bottom external threading at the bottom distal end of the threaded rod secures; wherein the armatures of the piercing tip are equally spaced and arranged and form grooves that expand and contract as the armatures move.

4. The fence post extraction tool as described in claim 3 wherein the piercing tip also includes a point that is to be first inserted into said pre-drilled hole; wherein the pre-drilled hole shall have an inner diameter that is less than an outer armature width so as to produce a squeezing effect on the armatures when driven into the pre-drilled hole via the hammer sleeve.

5. The fence post extraction tool as described in claim 4 wherein the pre-drilled hole shall be drilled at a depth that is greater than a piercing tip length.

6. The fence post extraction tool as described in claim 2 wherein the hammer sleeve is pulled upwardly and rammed downwardly in order to impact a bottom hammer surface onto a top armature surface of the piercing tip.

7. The fence post extraction tool as described in claim 1 wherein the "+" shaped opening enables a lifting means to attach thereon such that the attachment clip is rigidly secured between the threaded rod and the lifting means.

8. The fence post extraction tool comprising: a threaded rod threadably engaged to a piercing tip that is hammered into a pre-drilled hole located on a top surface of a wooden fence post to be extracted upwardly along a vertical axis; wherein an attachment clip is secured between the threaded rod and a lifting means that is suspended under a tripod; wherein the threaded rod is of a length and has a bottom distal end as well as top distal end; wherein the bottom distal end includes a shoulder from which are bottom external threading; wherein the top distal end includes top external threadings for use with a threaded nut; wherein the attachment clip has an "L" shape further defined by a vertical portion and a horizontal portion; wherein the vertical portion includes a "+" shaped opening whereas the horizontal portion and vertical portion share a grooved slot; wherein the grooved slot enables the top distal end to pass through and engage against the threaded nut.

9. The fence post extraction tool as described in claim 8 wherein a hammer sleeve is included with the threaded rod and is slideably engaged therewith; wherein the hammer sleeve has the shape of a hollowed cylinder having an inner diameter greater than an outer diameter of the threaded rod.

10. The fence post extraction tool as described in 9 wherein the hammer sleeve has a hammer length that is less than the length of the threaded rod; wherein the hammer sleeve is used to generate a downward force that hammers the piercing tip into said pre-drilled hole.

11. The fence post extraction tool as described in claim 10 wherein the piercing tip includes armatures that branch upwardly and outwardly from a threaded hole into which the bottom external threading at the bottom distal end of the threaded rod secures; wherein the armatures of the piercing tip are equally spaced and arranged and form grooves that expand and contract as the armatures move.

12. The fence post extraction tool as described in claim 11 wherein the piercing tip also includes a point that is to be first inserted into said pre-drilled hole; wherein the pre-drilled hole shall have an inner diameter that is less than an outer armature width so as to produce a squeezing effect on the armatures when driven into the pre-drilled hole via the hammer sleeve.

13. The fence post extraction tool as described in claim 12 wherein the pre-drilled hole shall be drilled at a depth that is greater than a piercing tip length.

14. The fence post extraction tool as described in claim 13 wherein the hammer sleeve is pulled upwardly and rammed downwardly in order to impact a bottom hammer surface onto a top armature surface of the piercing tip.

15. The fence post extraction tool as described in claim 8, wherein the "+" shaped opening enables a lifting means to attach thereon such that the attachment clip is rigidly secured between the threaded rod and the lifting means.

* * * * *